US011779166B2

(12) United States Patent
Chang

(10) Patent No.: US 11,779,166 B2
(45) Date of Patent: Oct. 10, 2023

(54) BATH SCRUBBER WITH HANDLE

(71) Applicant: OLIVETTE INDUSTRIES CO., LTD., Changhua County (TW)

(72) Inventor: Che-Yuan Chang, Yuanlin (TW)

(73) Assignee: OLIVETTE INDUSTRIES CO., LTD., Changhua County (TW)

( * ) Notice: Subject to any disclaimer, the term of this patent is extended or adjusted under 35 U.S.C. 154(b) by 361 days.

(21) Appl. No.: 17/149,332

(22) Filed: Jan. 14, 2021

(65) Prior Publication Data

US 2022/0192437 A1 Jun. 23, 2022

(30) Foreign Application Priority Data

Dec. 23, 2020 (TW) ..... 109145796

(51) Int. Cl.

*A47K 7/02* (2006.01)
*A46B 5/00* (2006.01)
*A46B 9/00* (2006.01)

(52) U.S. Cl.

CPC ..... *A47K 7/028* (2013.01); *A46B 5/0095* (2013.01); *A46B 9/005* (2013.01); *A46B 2200/1006* (2013.01)

(58) Field of Classification Search

CPC .. A47K 7/02; A47K 7/028; A46B 2200/1006; A46B 5/0095; A46B 5/02; A46B 9/005; A47L 13/44; A47L 13/06

See application file for complete search history.

(56) References Cited

U.S. PATENT DOCUMENTS

| | | | | |
|---|---|---|---|---|
| 5,205,012 | A * | 4/1993 | Coley | A47L 13/46 15/228 |
| 9,713,404 | B2 * | 7/2017 | Hessler | B25G 1/102 |
| 10,786,123 | B1 * | 9/2020 | Chang | A47K 7/028 |
| 11,419,461 | B1 * | 8/2022 | Papageorge | A47K 7/028 |
| 11,458,515 | B2 * | 10/2022 | Harrington | A47L 13/44 |
| 2004/0200022 | A1 * | 10/2004 | Hsu | A47K 7/028 15/209.1 |
| 2006/0118130 | A1 * | 6/2006 | Little | A46B 5/00 132/147 |

(Continued)

FOREIGN PATENT DOCUMENTS

| | | |
|---|---|---|
| TW | 216512 | 11/1993 |
| TW | 578539 | 3/2004 |

*Primary Examiner* — Eric J Rosen
*Assistant Examiner* — Sharonda T Felton
(74) *Attorney, Agent, or Firm* — MUNCY, GEISSLER, OLDS & LOWE, P.C.

(57) ABSTRACT

A bath scrubber includes an elongated handle, a scrubbing member, and a tightening member. The handle has a positioning structure at one end thereof, a first side and a second side opposite to the first side. The positioning structure includes a first position-limiting hole and a second position-limiting hole run through the first side and the second side, and a first anti-slip portion located between the first and second position-limiting holes. The first and second position-limiting holes and the first anti-slip portion are arranged on an axis. The tightening member is fastened to the scrubbing member and inserted through the first and second position-limiting holes to fix the scrubbing member on the handle and to make the scrubbing member engage in the first anti-slip portion.

8 Claims, 9 Drawing Sheets

(56) References Cited

U.S. PATENT DOCUMENTS

| | | | | |
|---|---|---|---|---|
| 2006/0171767 | A1* | 8/2006 | Hoadley | A46B 11/0006 401/136 |
| 2007/0256264 | A1* | 11/2007 | Chen | A47K 7/028 15/147.1 |
| 2008/0155773 | A1 | 7/2008 | Chen | |
| 2011/0191973 | A1* | 8/2011 | Chen | A47K 7/028 15/210.1 |
| 2014/0033459 | A1* | 2/2014 | Chang | A46B 9/005 15/176.6 |
| 2017/0231456 | A1* | 8/2017 | Weilage | A46B 7/042 15/144.4 |
| 2017/0251887 | A1* | 9/2017 | Hessler | A47K 7/028 |

* cited by examiner

BATH SCRUBBER WITH HANDLE

BACKGROUND OF THE INVENTION

1. Field of the Invention

The present invention relates to a bath scrubber that can be used to scrub the body, and in particular refers to a bath scrubber with a handle.

2. Description of the Related Art

When using scrubbing members such as bath balls or sponges, the user needs to hold the scrubbing member with his hands to scrub the body, thereby achieving a clean body. However, these scrubbing members are inconvenient for users to scrub their backs and feet. In order to solve the problem of insufficient applicability of the aforementioned conventional scrubbing member, a handle with a considerable length that can be used to fix the aforementioned conventional scrubbing member has been developed and widely used.

For example, Taiwan Utility Patent No. 578539 provides a combined bath scrubber handle. The bath scrubber mainly consists of a bath ball and a handle. The handle includes a positioning structure composed of several protruding rods and a perforation. The central part of the bath ball is tightly tied with a flexible bundle that is inserted through the perforation and knotted, so that the protruding rods are inserted into the bath ball. In this way, the bath ball is fixed on the handle. In the aforementioned patent, although the protruding rods are inserted into the interior of the bath ball to assist in fixing the bath ball to prevent excessive shaking of the bath ball during use, however, if the user exerts improper force, it is easy to cause discomfort to the user due to the protruding rods scratching the uses skin, and in the worst case, there is a risk of pulling the bath ball to damage. In addition, the handle provided by this patent can only be used to fix the bath ball on one side, and cannot provide the user with a multifaceted cleaning effect.

Please refer to Taiwan Utility Patent No. 216512, which discloses another type of bath scrubber, which includes a handle with a ring at the end, a long cylindrical net body, and a bundle. After using the bundle to wrap the long cylindrical net body to form two hemispherical bodies, pass one of the two hemispherical bodies through the ring of the handle, so that the two hemispherical bodies are placed on both sides of the handle. When the bath scrubber is in use, the two hemispherical bodies are prone to slide with the user's scrubbing action, causing inaccurate scrubbing and reducing the cleaning effect. Moreover, the ring of the handle can only be mounted with one net body, which cannot increase the cleaning area.

In addition, U.S. Patent No. US2008/0155773 discloses a scrubbing member with a long handle. The long handle includes an assembly part with a long perforation and an assembly clip. The two ends of the assembly clip each have a pressing portion, and the two ends of the long perforation of the assembly part have connecting portions corresponding to the two pressing portions. A bath ball is clamped between the assembly part and the assembly clip of the long handle. Based on this, a scrubbing member with simple structure and easy assembly is provided. However, this kind of long handle is complicated to fabricate and expensive, and it can only be used on one side.

SUMMARY OF THE INVENTION

In view of the above-mentioned deficiencies, the present invention provides a bath scrubber that can solve at least one of the above-mentioned deficiencies, it is the main object of the present invention to provide a bath scrubber with a long handle, which can prevent the scrubbing member from sliding relative to the handle during use.

It is another object of the present invention to provide a bath scrubber, which can be provided with more than one scrubbing member on one side or on both sides, so as to provide multi-faceted and multiple scrubbing parts, thereby improving the cleaning effect.

It is still another object of the present invention to provide a bath scrubber, which is not easy to scratch the user's skin during use.

To achieve this and other objects of the present invention, a bath scrubber comprises an elongated handle, a first scrubbing member, and a first tightening member. The elongated handle comprises a positioning structure located at one end thereof, a first side and a second side opposite to the first side. The positioning structure comprises a first position-limiting hole and a second position-limiting hole run through the first side and the second side, and a first anti-slip portion located between the first position-limiting hole and the second position-limiting hole. The first position-limiting hole, the second position-limiting hole and the first anti-slip portion being arranged on an axis. The first tightening member is fixed to the first scrubbing member and inserted through the first position-limiting hole and the second position-limiting hole and fastened to the handle to fix the first scrubbing member to the handle and to make the first scrubbing member engage in the first anti-slip portion.

With the above technical features, since the scrubbing member is firmly fixed to the handle by the tightening member and engaged in the first anti-slip portion, the anti-slip effect and connection stability between the handle and the scrubbing member can be increased, making the first scrubbing member not easy to slide relative to the handle during use.

In one embodiment of the present invention, the positioning structure further comprises a third position-limiting hole run through the first side and the second side, and a second anti-slip portion located between the second position-limiting hole and the third position-limiting hole. The first anti-slip portion, the second anti-slip portion and the first to third position-limiting holes are arranged on the axis. The first anti-slip portion and the second anti slip portion both are formed on the first side. The bath scrubber further comprises a second scrubbing member and a second tightening member. The second tightening member is inserted through the second position-limiting hole and the third position-limiting hole to fix the second scrubbing member on the handle and to make the second scrubbing member engage in the second anti-slip portion. In this way, two scrubbing members can be provided on the handle, thereby improving the cleaning effect.

In another embodiment of the present invention, the positioning structure further comprises a third anti-slip portion located between the first position-limiting hole and the second position-limiting hole, and a fourth anti-slip portion located between the second position-limiting hole and the third position-limiting hole. The third anti-slip portion and the fourth anti-slip portion both are formed on the second side. The bath scrubber further comprises a third scrubbing member and a fourth scrubbing member. The first tightening member also fix the third scrubbing member on the handle to make the third scrubbing member engage in the third anti-slip portion. The second tightening member also fix the fourth scrubbing member on the handle to make the fourth scrubbing member engage in the fourth anti-slip portion. In this way, multiple scrubbing parts (scrubbing members) are provided on multiple sides of the handle, thereby improving the cleaning effect.

Preferably, the aperture of the second position-limiting hole is larger than the aperture of the first position-limiting hole and the aperture of the third position-limiting hole. With this, the first and second tightening members can easily pass through the second position-limiting hole at the same time.

In one embodiment of the present invention, the first anti-slip portion is located on the first side. The positioning structure further comprises a third anti-slip portion located between the first position-limiting hole and the second position-limiting hole and formed on the second side. The bath scrubber further comprises a third scrubbing member. The first tightening member also fix the third scrubbing member on the handle to make the third scrubbing member engage in the third anti-slip portion. In this way, multiple scrubbing parts (scrubbing members) can be provided on multiple sides of the handle, thereby improving the cleaning effect.

Preferably, the positioning structure of the handle is a straight line structure, and the width from the top of the positioning structure to the bottom of the positioning structure is the same.

Preferably, the handle comprises a grip located at an opposite end thereof remote from the positioning structure. The width and area of the positioning structure are equal to or smaller than the width and area of the grip.

Preferably, the first anti-slip portion comprises a plurality of strip-like protrusions, and a plurality of grooves separated by the strip-like protrusions. In this way, the scrubbing member can be engaged in each groove and firmly fixed to the handle.

Preferably, each strip-like protrusion comprises two side ends and a middle part located between the two side ends, and the protrusion height of each strip-like protrusion decreases from the middle part to the two side ends, so that each strip-like protrusion is half arc. In this way, when the user uses the bath scrubber provided by the present invention, each strip-like protrusion is stamped or even directly touched the user's skin through the scrubbing member, and each strip-like protrusion will not scratch the user's skin, and can provide the user with a smooth contact massage effect.

Preferably, the trip-like protrusions are arranged at intervals along the axis, including, along the axis direction, a top strip-like protrusion at a top side, a bottom strip-like protrusion at a bottom side, and a middle strip-like protrusion at the center between the top strip-like protrusion and the bottom strip-like protrusion. The widths of the strip-like protrusion are so configured that the middle strip-like protrusion has the widest width, the top strip-like protrusion and the bottom strip-like protrusion have the smallest width, and the widths of the other strip-like protrusions become smaller toward the top strip-like protrusion and the bottom strip-like protrusion. In this way, the scrubbing member can be more easily engaged in each groove and firmly fixed on the handle. Once each strip-like protrusion is imprinted or even directly touched the user's skin through the scrubbing member, each strip-like protrusion is not easy to scratch the user's skin, and can provide the user with a smoother contact massage effect.

The detailed structure, characteristics assembly or use of the bath scrubber with handle provided by the present invention will be described in the detailed description of the subsequent preferred embodiments. However, those with ordinary knowledge in the field of the present invention should be able to understand that these detailed descriptions and the specific embodiments listed in the implementation of the present invention are only used to illustrate the present invention, and are not intended to limit the scope of the patent application of the present invention.

DETAILED DESCRIPTION OF THE INVENTION

The Applicant first describes here, in the entire specification, including the preferred embodiment described below and the claims of the patent application, the directional adjectives such as "top, bottom, up, down, inside, and outside" mentioned in the content of this manual are only exemplary description terms based on the normal direction of use, and are not intended to limit the scope of claims. Secondly, in the embodiments and drawings that will be introduced below, the same element numbers represent the same or similar elements or their structural features.

Figure 1:
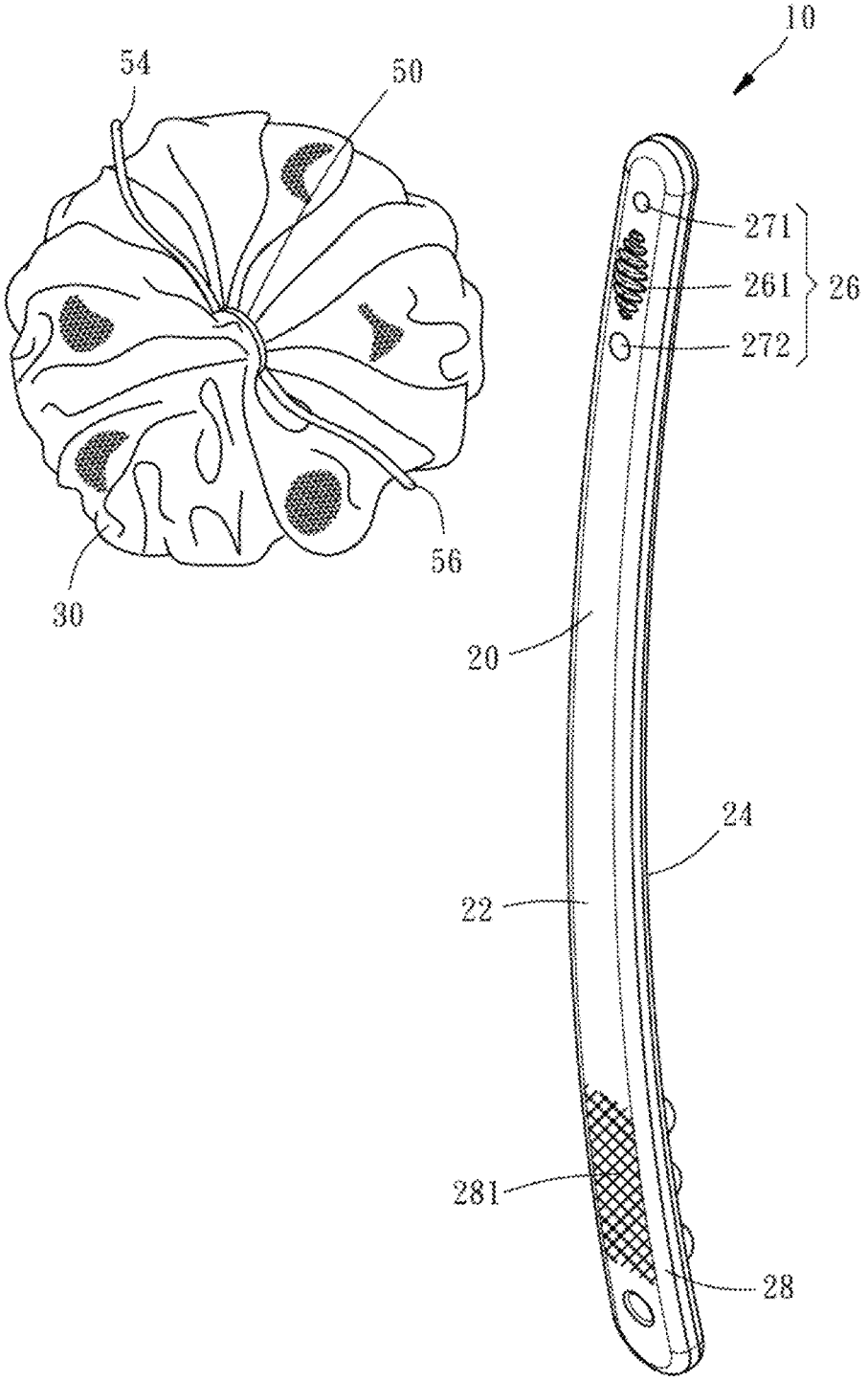
FIG. 1 is an exploded view of a bath scrubber in accordance with a first embodiment of the present invention.
Figure 2:
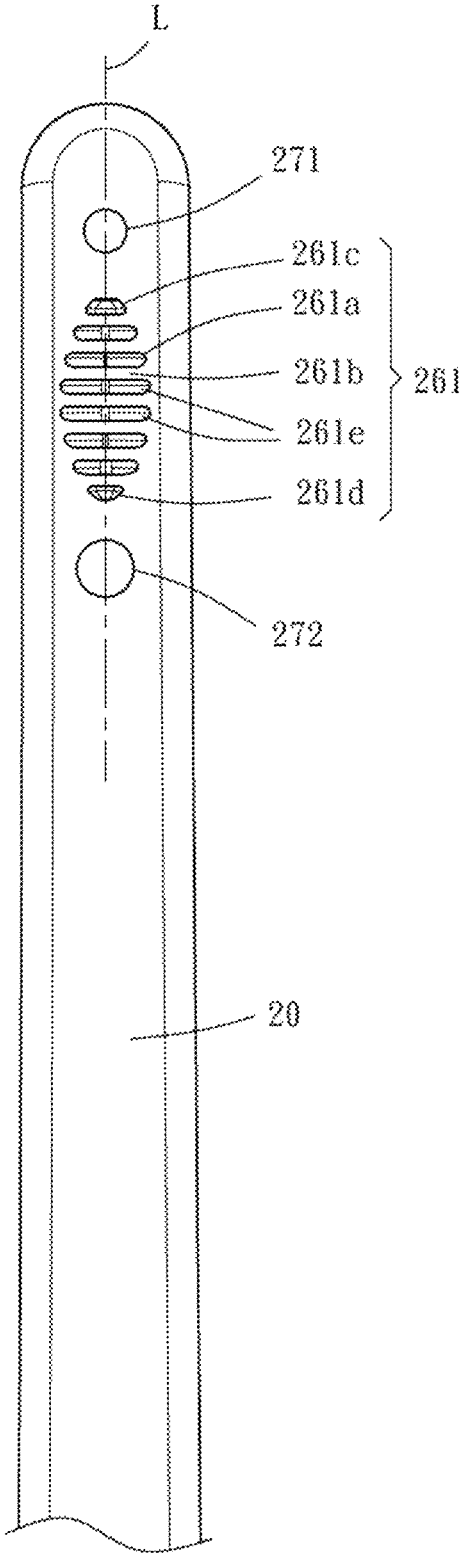
FIG. 2 is a front view, in an enlarged scale of the handle of the bath scrubber in accordance with the first embodiment of the present invention.
Figure 3:
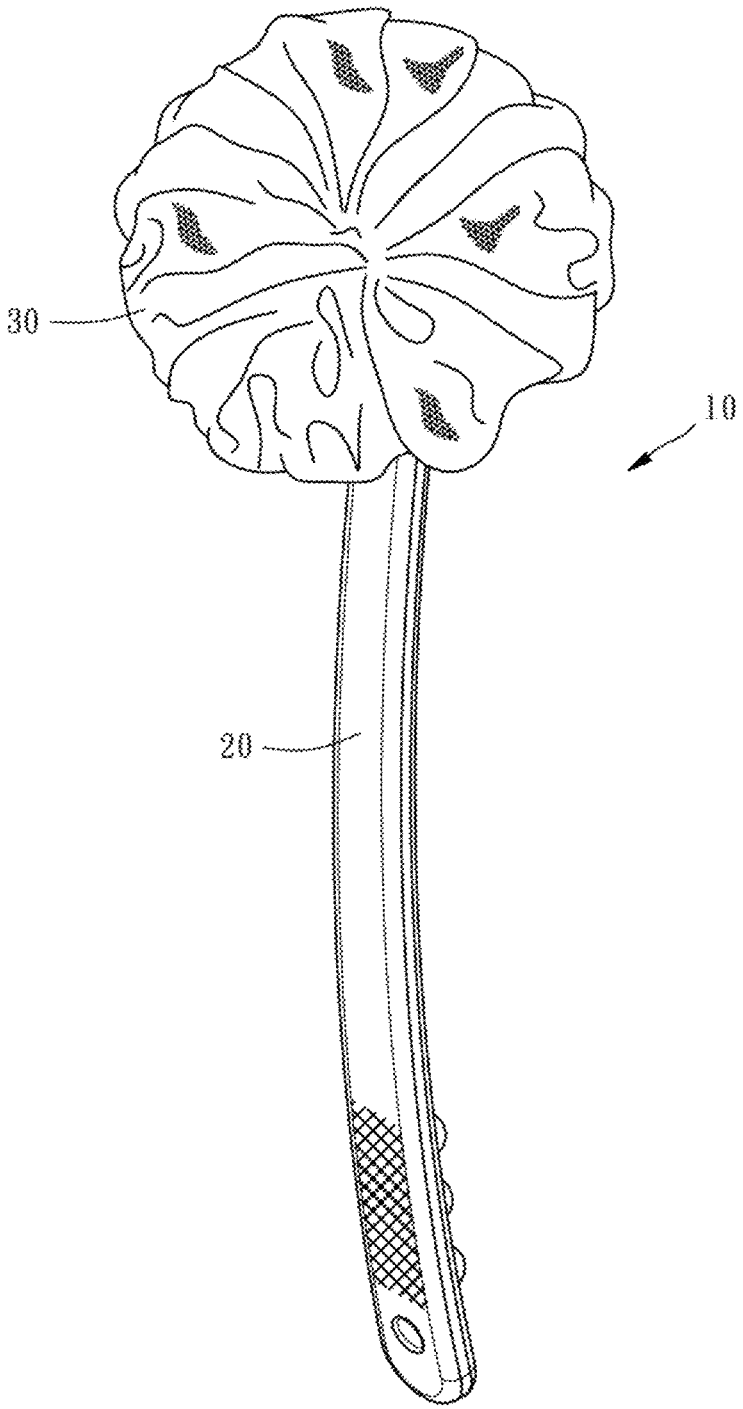
FIG. 3 is a schematic elevational assembly view of the first embodiment of the present invention, showing one scrubbing member tied to the handle.

Referring to FIGS. 1-3, a bath scrubber 10 in accordance with a first embodiment of the present invention comprises a handle 20, a first scrubbing member 30, and a tightening member 50.

The handle 20 is a strip-shaped element made of plastic, wood or other suitable materials, and comprises a first side 22 and a second side 24 opposed to each other, a positioning structure 26 located at one end thereof, and a grip 28 located at an opposite end thereof.

The positioning structure 26 comprises a first position-limiting hole 271, a second position-limiting hole 272 and a first anti-slip portion 261. The first position-limiting hole 271 and the second position-limiting hole 272 run through the first side 22 and the second side 24. The first anti-slip portion 261 is located on the first side 22 between the first position-limiting hole 271 and the second position-limiting hole 272. Moreover, the first anti-slip portion 261, the first position-limiting hole 271 and the second position-limiting hole 272 are arranged at intervals along the axis L of the handle 20. In this embodiment, the first anti-slip portion 261 comprises a plurality of strip-like protrusions 261*a* extending laterally and arranged at intervals on the axis L, and a plurality of grooves 261*b* respectively defined between each two adjacent strip-like protrusions 261*a*. The strip-like protrusion 261*a* has two side ends and a middle part located between the two side ends. The axis L passes through the middle part of each strip-like protrusion 261*a*. These strip-like protrusions 261*a* protrude from the first side 22, and the protrusion height of each strip-like protrusion 261*a* gradually decreases from the middle part to the two side ends, so that the strip-like protrusions 261*a* present a semi-arc shape with a smooth top edge. Secondly, these strip-like protrusions 261*a* are arranged at intervals along the axis L, including, along the axis L direction, a top strip-like protrusion 261*c* at the top side, a bottom strip-like protrusion 261*d* at the bottom side, and one or two middle strip-like protrusions 261*e* at the center area. Moreover, the widths of these strip-like protrusions 261*a* are so configured that the middle strip-like protrusion 261*e* has the widest width, the more to the direction of the top strip-like protrusion 261*c* or the bottom strip-like protrusion 261*d* the smaller the width of the strip-like protrusions 261*a*. In turn, an arc-shaped anti-slip portion is formed. In addition, the positioning, structure 26 is a straight line structure, that is, the width from the top to the bottom of the positioning structure 26 is consistent. The grip 28 has an arc, the area and width of the grip 28 are equal to or greater than the area and width of the positioning structure 26, and the outer surface of the grip 28 is a rough non-slip surface 281.

The structure, material and formation method of the first scrubbing member 30 are similar to those of the conventional net scrubber (for example, the one disclosed in Taiwan Utility Patent No. 216512). In detail, a long tubular plastic net body is continuously folded into a wavy short tube, and then the tightening member 50, which is realized by a plastic or cotton rope in this embodiment, is used, wound and bound in the central part of the folded net body to form a net sphere for washing the body and the net sphere is fixed on the handle 20. In detail, after the tightening member 50 is wound and bound to the folded net body to form the first scrubbing member 30 into a net sphere, the two end sections of the tightening member 50, namely the first tightening section 54 and the second tightening section 56 are respectively inserted through the first position-limiting hole 271 and the second position-limiting hole 272 on both sides of the first anti-slip portion 261. After tightening the first scrubbing member 30 in the direction of the first anti-slip portion 261 through the first tightening section 54 and the second tightening section 56, the first tightening section 54 and the second tightening section 56 are tied to each other on the second side 24. In addition to the wearing relationship of the tightening member 50 between the first scrubbing member 30 and the handle 20, the first scrubbing member 30 is forced to be engaged in each groove 261*b* of the first anti-slip portion 261, thereby making the first anti-slip portion 261 restrict the relative position of the first scrubbing member 30 and the handle 20 to prevent displacement of the first scrubbing member 30 relative to the handle 20 during use. In other words, since the first scrubbing member 30 is firmly fixed to the handle 20 by the tightening member 50 and is engaged in the first anti-slip portion 261, the anti-slip effect and the fixing stability between the handle 20 and the first scrubbing member 30 can be increased, so that the first scrubbing member 30 is not easy to slide relative to the handle 20 during use, achieving the effect of the present invention. It must be noted that the first scrubbing member 30 disclosed in the present invention is not limited to those made of a long tubular net body, and in practice, the first scrubbing member 30 can be a round net body or sponge. Moreover, the tightening member 50 is not limited to a rope, but can also be a drawstring.

Figure 4:
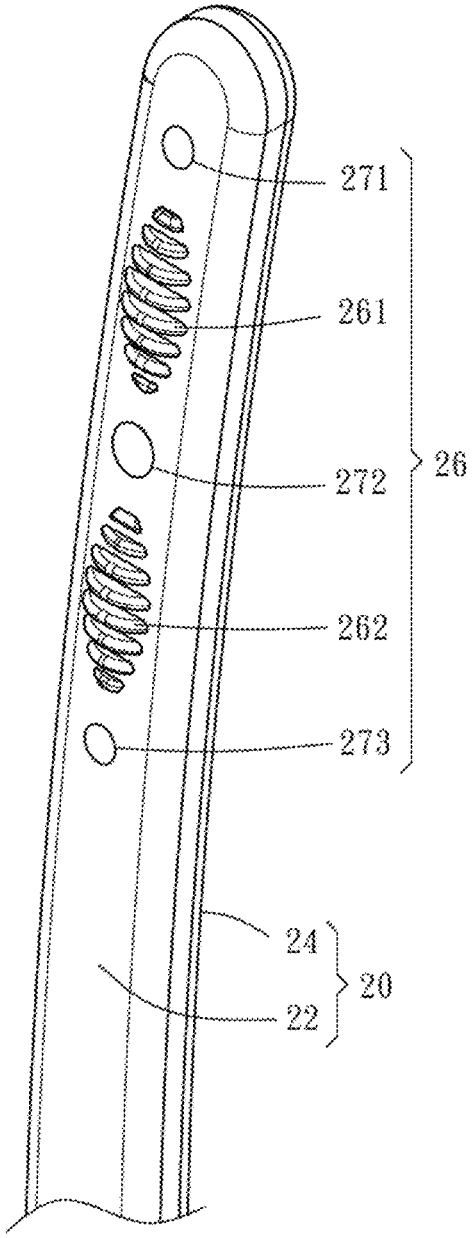
FIG. 4 is an enlarged elevational view of a part of a handle for bath scrubber in accordance with a second embodiment of the present invention.
Figure 5:
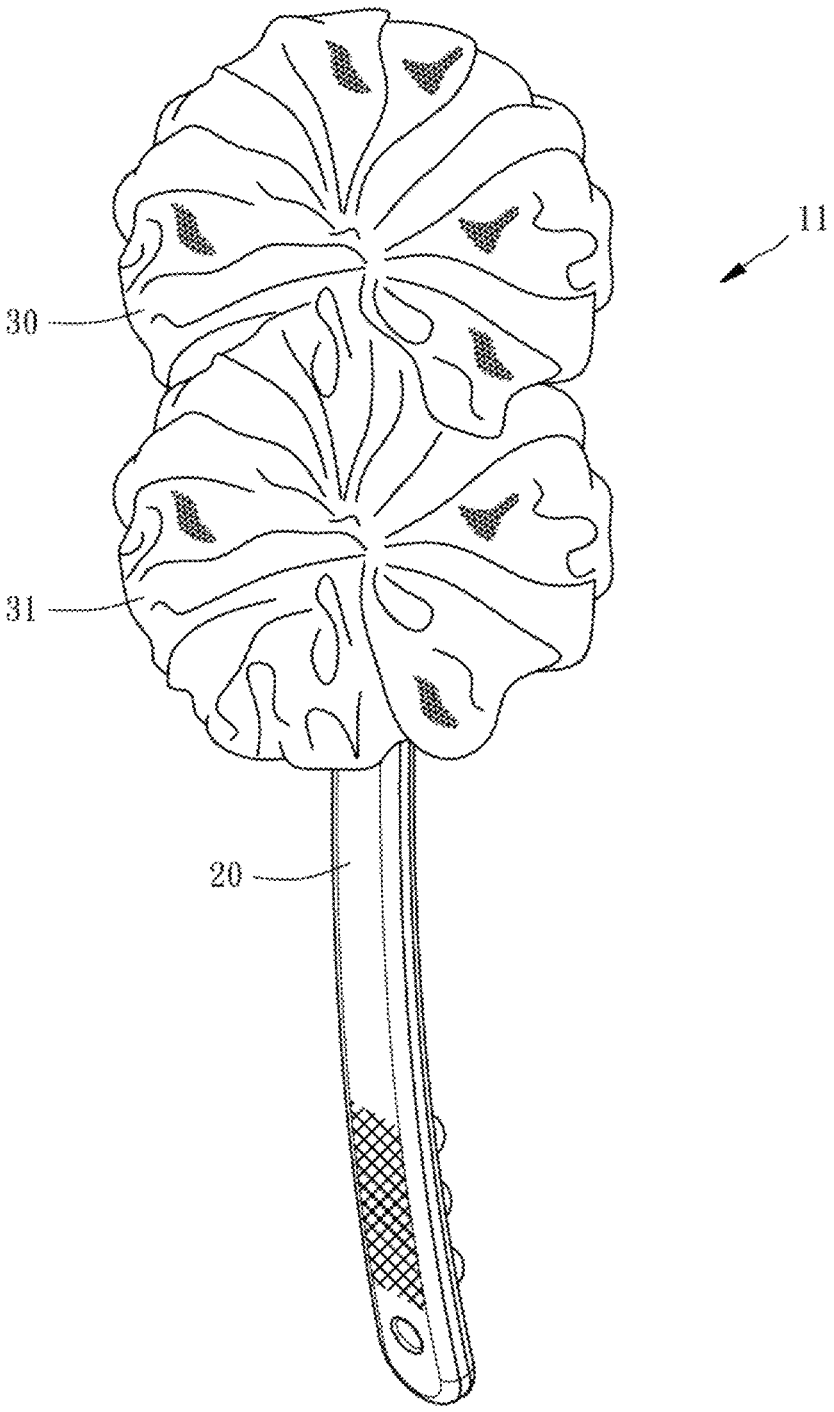
FIG. 5 is a schematic elevational assembly view of the second embodiment of the present invention, showing two scrubbing members tied to the handle.

FIGS. 4 and 5 illustrate a bath scrubber 11 in accordance with a second embodiment of the present invention. The difference from the bath scrubber 10 provided by the first embodiment is outlined hereinafter. The positioning structure 26 of the handle 20 further comprises a third position-limiting hole 273 located on the axis L and passing through the first side 22 and second side 24, and a second anti-slip portion 262 located between the second position-limiting hole 272 and the third position-limiting hole 273. The first anti-slip portion 261 and the second anti-slip portion 262 are both formed on the first side 22, and the structure of the second anti-slip portion 262 is the same as the structure of the first anti-slip portion 261. Both the first anti-slip portion 261 and the second anti-slip portion 262 have multiple strip-like protrusions arranged intervals along the axis L, and multiple grooves separated by these strip-like protrusions. The detailed structure of the second anti-slip portion 262 allows the applicant to not repeat it here. Secondly, the bath scrubber 11 of this embodiment further comprises a second scrubbing member 31 and a second tightening member (not shown). Like the function of the first tightening member 50, the second tightening member is bundled and fixed to the second scrubbing member 31 and inserted through the second position-limiting hole 272 and the third position-limiting hole 273, and then is knotted and fixed to the handle 20 to tighten the second scrubbing member 31 and fix it to the handle 20, so that the second scrubbing member 31 is engaged in the second anti-slip portion 262. In this way, the first scrubbing member 30 and the second scrubbing member 31 can be provided on the handle 20 to increase the cleaning area and improve the cleaning effect. In this embodiment, the first tightening member 50 and the second tightening member are used to bind the first scrubbing member 30 and the second scrubbing member 31 to the positioning structure 26, respectively. However, the present invention is not limited to this. For example, a single tightening member, i.e., the same tightening member 50 can be used to bind the first scrubbing member 30 and the second scrubbing member 31 to the positioning structure 26, or can be two ropes or nylon bundles can be used to bind the first scrubbing member 30 and the second scrubbing member 31 to the positioning structure 26.

Figure 6:
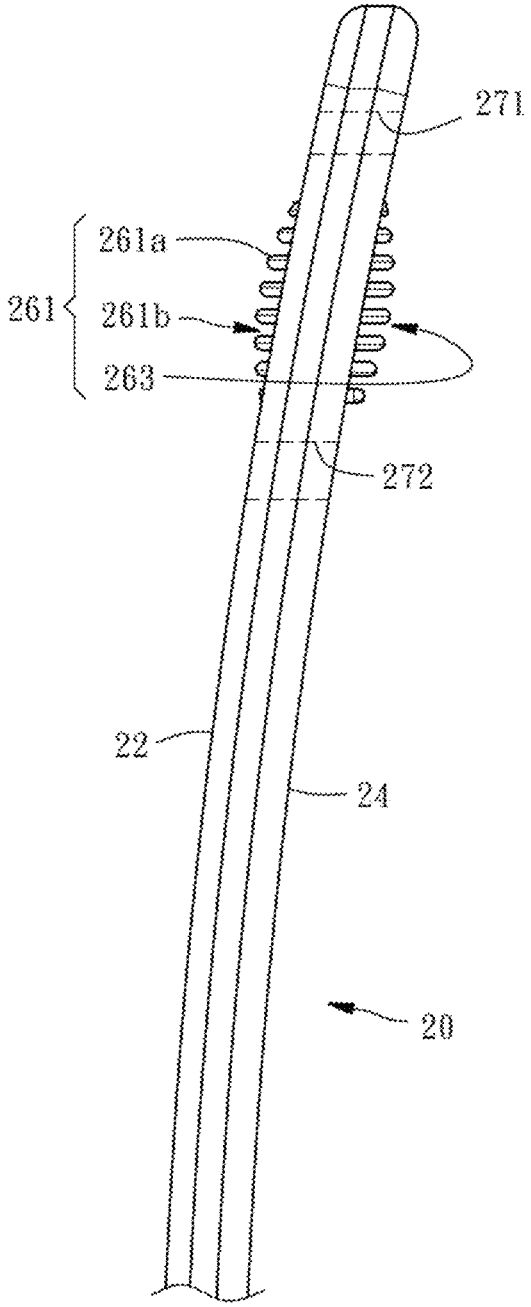
FIG. 6 is an enlarged sectional side view of a part of a handle for bath scrubber in accordance with a third embodiment of the present invention.
Figure 7:
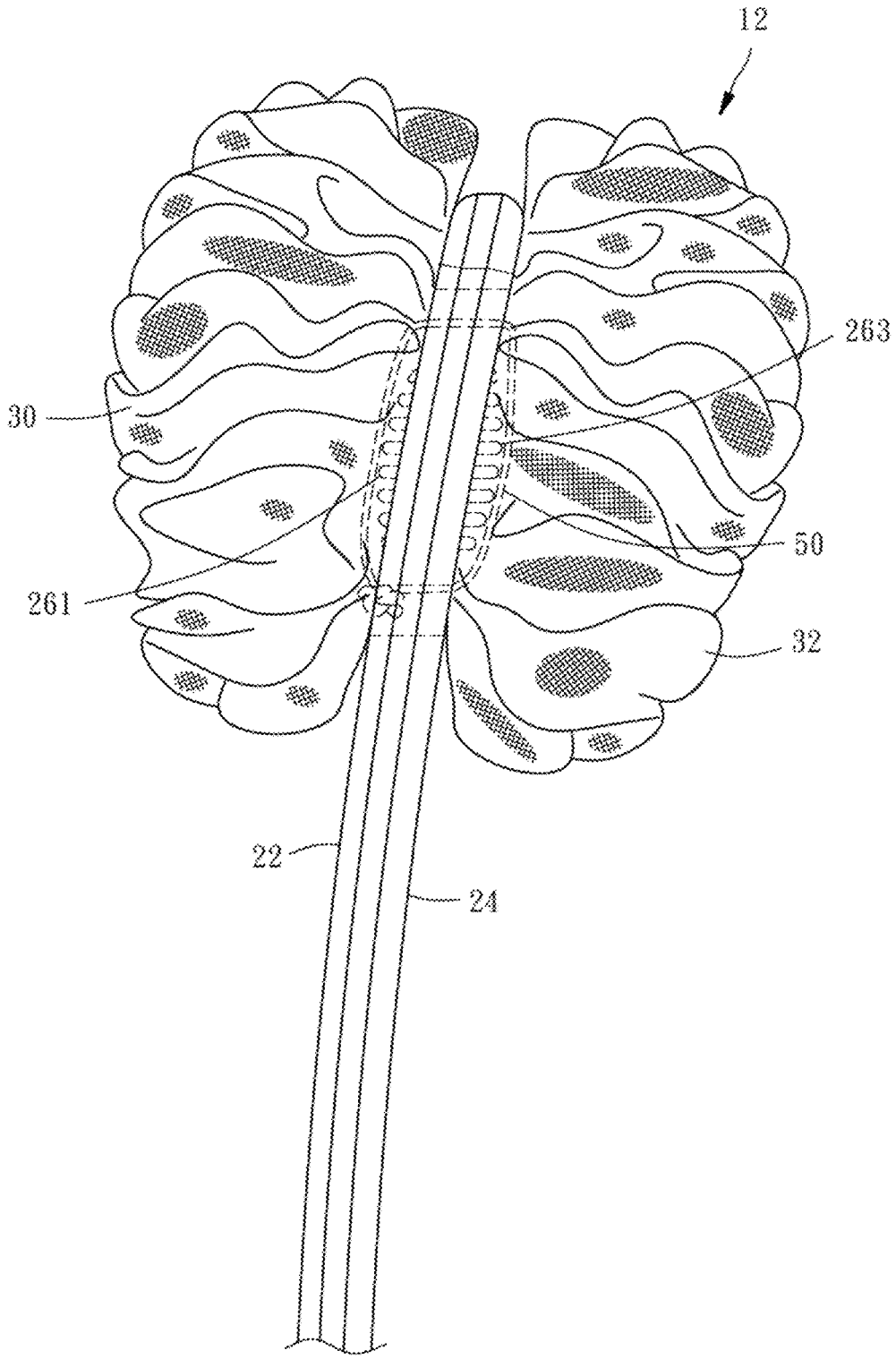
FIG. 7 is a schematic sectional side view of the bath scrubber in accordance with the third embodiment of the present invention, showing two scrubbing members tied to two opposite lateral sides of the handle.

FIGS. 6 and 7 illustrate a bath scrubber 12 in accordance with a third embodiment of the present invention. The difference from the bath scrubber 10 provided by the first embodiment is outlined hereinafter. The positioning structure 26 further comprises a third anti-slip portion 263 formed on the second side 24 opposite to the first anti-slip portion 261. The structure of the third anti-slip portion 263 is the same as the structure of the first anti-slip portion 261, so its detailed structure is for the applicant to not repeat it here. Moreover, the bath scrubber 12 of this embodiment thither comprises a third scrubbing member 32 that is also fixed to the handle 20 by the first tightening member 50 and engaged in the third anti-slip portion 263. In this way, multiple scrubbing parts (first, second and third scrubbing members 30,31,32) can be provided on multiple sides of the handle 20, thereby improving the cleaning effect. Of course, a tightening member (not shown in the drawing) that is different from the first tightening member 50, that is, the third tightening member can be used to fix the third scrubbing member 32 on the handle 20.

Figure 8:
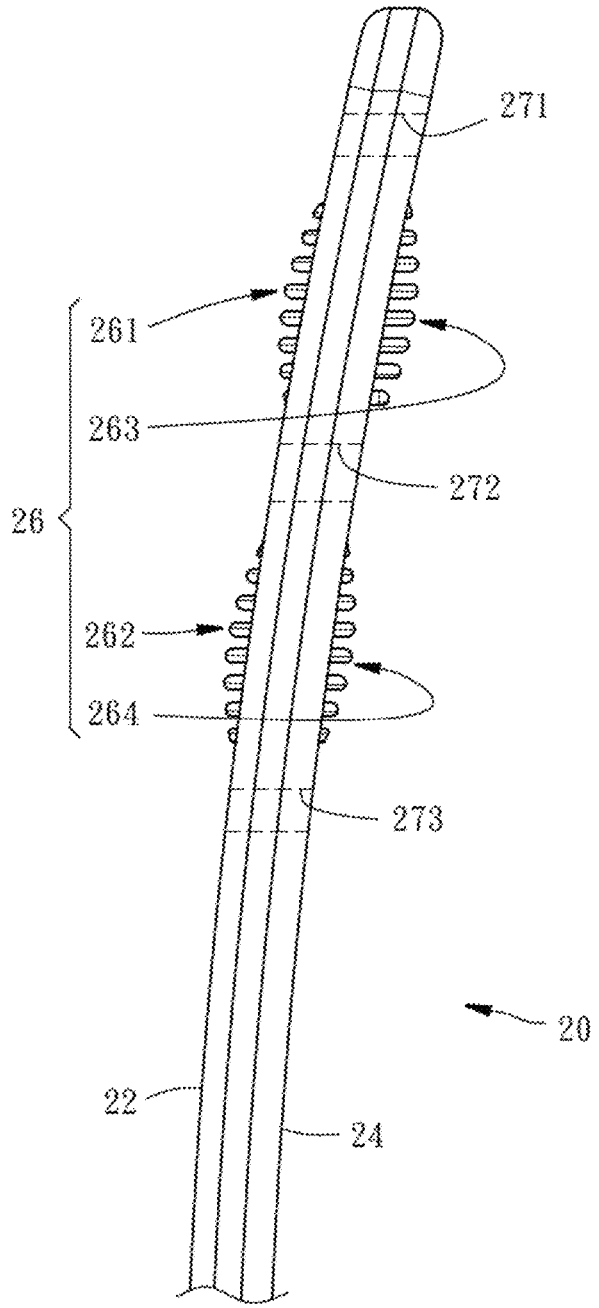
FIG. 8 is an enlarged sectional side view of a part of a handle for bath scrubber in accordance with a fourth embodiment of the present invention.
Figure 9:
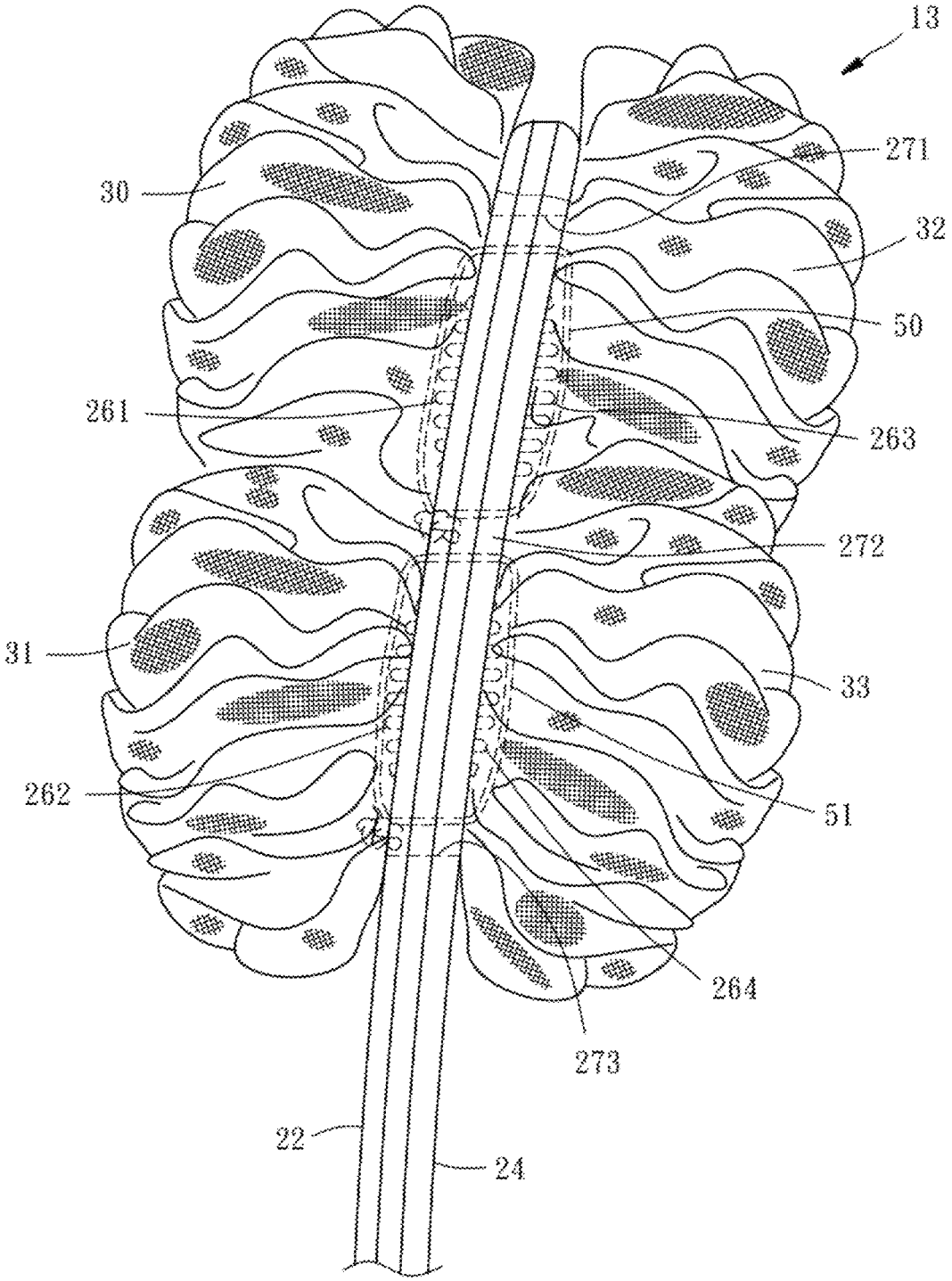
FIG. 9 is a schematic sectional side view of bath scrubber in accordance with the fourth embodiment of the present invention, showing four scrubbing members tied to the handle and arranged side by side on two opposite sides of the handle.

FIGS. 8 and 9 illustrate a bath scrubber 13 in accordance with a fourth embodiment of the present invention. The difference from the bath scrubber 11 provided by the second embodiment is outlined hereinafter. The positioning structure 26 further comprises a third anti-slip portion 263 located between the first position-limiting hole 271 and the second position-limiting hole 272, and a fourth anti slip portion 264 located between the second position-limiting hole 272 and the third position-limiting hole 273. The third anti-slip portion 263 and the fourth anti-slip portion 264 both are formed on the second side 24. In addition, the bath scrubber 13 of this fourth embodiment further comprises a third scrubbing member 32 and a fourth scrubbing member 33. The first tightening member 50 fix the first scrubbing member 30 and the third scrubbing member 32 to the handle 20 at the same time, so that the first scrubbing member 30 and the third scrubbing member 32 are engaged in the first anti-slip portion 261 and the third anti-slip portion 263 respectively. The second tightening member 51 fix the second scrubbing member 31 and the fourth scrubbing member 33 to the handle 20 at the same time, so that the second scrubbing member 31 and the fourth scrubbing member 33 are engaged in the second anti-slip portion 262 and the fourth anti-slip portion 264 respectively. In this way, multiple scrubbing parts (first, second, third and fourth scrubbing members 30-33) can be provided on different sides of the handle 20, thereby improving the cleaning effect. Of course, the first to fourth scrubbing members 30 to 33 can be fixed on the handle 20 with one respective tightening member, or fixed on the handle with only one tightening member. It is worth mentioning that in the fourth embodiment, the first, second and third position-limiting holes 271, 272, and 273 have different apertures, wherein the second position-limiting hole 272 located between the first anti slip portion 261 and the second anti-slip portion 262 and between the third anti-slip portion 263 and the fourth anti-slip portion 264 is a common position-limiting hole whose aperture is larger than the first and third position-limiting holes 271 and 273. With this, the first and second tightening members 50 and 51 can easily pass through the second position-limiting hole 272 at the same time. Furthermore, the design of the aperture size of the aforementioned position-limiting hole 272 is not intended to limit the present invention. For example, a fourth position-limiting hole (not shown) can also be opened under the second position-limiting hole 272 of the handle 20. As a result, the first, second, third and fourth anti-slip portions 261, 262, 263 and 264 all have two position-limiting holes on the top and bottom sides, and the first, second and third position-limiting holes 271, 272 and 273 and the fourth position-limiting hole not shown) can be designed to have the same aperture. On the other hand, the first anti-slip portion 261, the second anti-slip portion 262, the third anti-slip portion 263, and the fourth anti-slip portion 264 disclosed in the present invention all have the same structure.

In summary, the bath scrubber provided by each embodiment of the present invention, through the special configuration of the anti-slip portion and the position-limiting holes on the handle, can not only fix the scrubbing member on the handle, but also engage the scrubbing member into the anti-slip portion scrubbing member, so that the scrubbing member is not easy to slide relative to the handle daring use. Secondly, with the special configuration of the aforementioned anti-slip portion and the position-limiting holes, multiple scrubbing members can be provided on multiple sides of the handle to improve the cleaning effect. In addition, with the special configuration of the position, protrusion height and width of the multiple strip-like protrusions of the anti-slip portion, the scrubbing member be firmly engaged in the anti-slip portion. Even when the user uses the bath scrubber, each strip-like protrusion is imprinted or even directly touched the user's skin through the scrubbing member, and each strip-like protrusion will not scratch the user's skin, and can provide the user with a smooth contact massage effect.

What is claimed is:

1. A bath scrubber, comprising:

an elongated handle comprising a positioning structure located at one end thereof, a first side and a second side opposite to said first side, said positioning structure comprising a first position-limiting hole and a second position-limiting hole run through said first side and said second side and a first anti-slip portion located between said first position-limiting hole and said second position-limiting hole, said first position-limiting hole, said second position-limiting hole and said first anti-slip portion being arranged on an axis;

a first scrubbing member; and a first tightening member fixed to said first scrubbing member and inserted through said first position-limiting hole and said second position-limiting hole and fastened to said handle to fix said first scrubbing member to said handle and to make said first scrubbing member engage in said first anti-slip portion;

wherein said first anti-slip portion comprises a plurality of strip-like protrusions, and a plurality of grooves separated by said strip-like protrusions;

wherein each said strip-like protrusion comprises two side ends and a middle part located between said two side ends, and a protrusion height of each said strip-like protrusion decreases from said middle part to said two side ends, so that each strip-like protrusion is a half arc, and said first tightening member forces said first scrubbing member into the plurality of grooves of said first anti-slip portion.

2. The bath scrubber as claimed in claim 1, wherein said positioning structure further comprises a third position-limiting hole run through said first side and said second side and a second anti-slip portion located between said second position-limiting hole and said third position-limiting hole, said first anti-slip portion and said second anti-slip portion and said first to third position-limiting holes being arranged on said axis, said first anti-slip portion and said second anti-slip portion both being formed on said first side; the bath scrubber further comprises a second scrubbing member and a second tightening member, said second tightening member being inserted through said second position-limiting hole and said third position-limiting hole to fix said second scrubbing member on said handle and to make said second scrubbing member engage in said second anti-slip portion.

3. The bath scrubber as claimed in claim 2, wherein said positioning structure further comprises a third anti-slip portion located between said first position-limiting hole and said second position-limiting hole, and a fourth anti-slip portion located between said second position-limiting hole and said third position-limiting hole, said third anti-slip portion and said fourth anti-slip portion both being formed on said second side; the bath scrubber further comprises a third scrubbing member and a fourth scrubbing member; said first tightening member also fix said third scrubbing member on said handle to make said third scrubbing member engage in said third anti-slip portion; said second tightening member also fix said fourth scrubbing member on said handle to make said fourth scrubbing member engage in said fourth anti-slip portion.

4. The bath scrubber as claimed in claim 2, wherein an aperture of said second position-limiting hole is larger than the aperture of said first position-limiting hole and the aperture of said third position-limiting hole.

5. The bath scrubber as claimed in claim 1, wherein said first anti-slip portion is located on said first side; said positioning structure further comprises a third anti-slip portion located between said first position-limiting hole and said second position-limiting hole and formed on said second side; the bath scrubber further comprises a third scrubbing member; said first tightening member also fix said third scrubbing member on said handle to make said third scrubbing member engage in said third anti-slip portion.

6. The bath scrubber as claimed in claim 1, wherein said positioning structure of said handle is a straight-line structure, and a width from a top of said positioning structure to an opposing bottom of said positioning structure is the same.

7. The bath scrubber as claimed in claim 6, wherein said handle comprises a grip located at an opposite end thereof remote from said positioning structure, the width and area of said positioning structure being equal to or smaller than the width and area of said grip.

8. The bath scrubber as claimed in claim 1, wherein said strip-like protrusions are arranged at intervals along said axis, including, along the axis, a top strip-like protrusion at a top side, a bottom strip-like protrusion at a bottom side, and a middle strip-like protrusion at a center between said top strip-like protrusion and bottom strip-like protrusion, widths of said strip-like protrusion being so configured that said middle strip-like protrusion has the widest width, said strip-like protrusion and said bottom strip-like protrusion have smallest width, and widths of the other said strip-like protrusions become smaller toward said top strip-like protrusion and said bottom strip-like protrusion.

* * * * *